US006471058B2

(12) United States Patent
Kannabiran et al.

(10) Patent No.: US 6,471,058 B2
(45) **Date of Patent: *Oct. 29, 2002**

(54) ARTICLE WITH IMPROVED TAMPER EVIDENCE

(75) Inventors: Rengan Kannabiran, Wayland, MA (US); Charles P. Kannankeril, North Caldwell, NJ (US); Donald E. Setter, Danbury, CT (US); Victor Todman, Impington (GB)

(73) Assignee: Sealed Air Corporation, Saddle Brook, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/849,903

(22) Filed: May 4, 2001

(65) Prior Publication Data

US 2001/0022280 A1 Sep. 20, 2001

Related U.S. Application Data

(62) Division of application No. 09/524,946, filed on Mar. 14, 2000.

(60) Provisional application No. 60/143,210, filed on Jul. 9, 1999.

(51) Int. Cl.[7] ..... B65D 85/00

(52) U.S. Cl. ..... 206/459.1; 383/5; 206/807

(58) Field of Search ..... 206/459.1, 459.5, 206/807; 383/5; 428/916

(56) References Cited

U.S. PATENT DOCUMENTS

| | | | | |
|---|---|---|---|---|
| 4,248,746 | A | 2/1981 | Greiner | 260/23 AR |
| 4,273,362 | A | 6/1981 | Carrier et al. | 283/6 |
| 4,756,758 | A | 7/1988 | Lent et al. | 106/22 |
| 4,937,040 | A | 6/1990 | Holcomb et al. | 383/5 |
| 4,972,953 | A | 11/1990 | Friedman et al. | 206/807 |
| 5,882,116 | A | 11/1990 | Backus | 383/5 |
| 5,158,606 | A | 10/1992 | Carlick et al. | 524/145 |
| 5,294,470 | A | 3/1994 | Ewan | 428/917 |
| 5,318,364 | A | 6/1994 | Radan | 383/5 |
| 5,407,277 | A | 4/1995 | Burke et al. | 383/5 |
| 6,264,033 | B1 * | 7/2001 | Kannabiran et al. | 206/459.1 |

FOREIGN PATENT DOCUMENTS

| | | |
|---|---|---|
| EP | 0 148 030 | 12/1984 |
| EP | 0 341 699 | 5/1989 |
| FR | 2 523 080 | 9/1983 |
| GB | 2 243 825 A | 11/1991 |
| GB | WO 93/00269 | 1/1993 |
| GB | 2 327 933 A | 2/1999 |
| WO | WO 96/04177 | 2/1996 |

* cited by examiner

*Primary Examiner*—David T. Fidei
(74) *Attorney, Agent, or Firm*—Mark B. Quatt

(57) ABSTRACT

An article, such as a tamper evident container, includes an indicator having a first layer including a thermochromic ink composition, and a second layer, disposed on the first layer, having a composition different from the ink composition of the first layer. The article exhibits better evidence of tampering. The first and/or second layer can be in the form of a message.

19 Claims, 11 Drawing Sheets

ARTICLE WITH IMPROVED TAMPER EVIDENCE

The present application is a division application of U.S. patent application Ser. No. 09/524,946 filed Mar. 14, 2000, the benefit of which is claimed under 35 USC Section 120.

This application claims the benefit of U.S. Provisional Application No. 60/143,210, filed Jul. 9, 1999.

FIELD OF THE INVENTION

The present invention relates to articles, more particularly to tamper evident containers such as tamper evident envelopes, characterized by improved evidence of tampering.

BACKGROUND OF THE INVENTION

It is known that banking establishments and the like use tamper evident containers for transmitting valuables, for example specified sums of money, securities, cash in transit (CIT), etc. from one department to another. The system operated by such establishments is such that it is readily possible to ascertain whether a tamper evident container has been stolen in transit. However it is ordinarily more difficult to ascertain whether the tamper evident container has been opened in transit and then resealed after some of the contents have been removed. In order to overcome this problem, tamper evident containers have been provided wherein any attempt to gain access to the interior of the tamper evident container becomes visibly apparent.

Typically, the walls of such tamper evident containers are formed of sheet material including a portion having an opening which gives access to the interior of the tamper evident container. The tamper evident containers include a closure portion arranged to be superposed on the portion having the opening, to close the tamper evident container. Closure is effected by means of a band of high-tack adhesive which is applied across the closure portion or the portion having the opening, for example from the molten state, from transfer tape, solvent cast or in the form of a tape. The adhesive may be pressure sensitive adhesive, and suitable adhesives include thermoplastic hot melt adhesives, silicone adhesives, acrylic pressure sensitive adhesives, solvent cast adhesives, UV (ultraviolet) or EB (electron beam) cured acrylic adhesives, and the like.

Such adhesives are required to have high initial tack with respect to the surface of the sheet material and also to have high adhesive and cohesive strength. In order to provide a visible indication of any attempt to open the tamper evident container by separating the closure portion and the portion having the opening, the adhesive should be strong enough to cause stretching, tearing, or other mechanical distortion of the portions upon attempted opening of the container. If desired, perforations or serrated edges may be provided in the closure portion to indicate tearing and emphasize the effect.

With the exception of silicone adhesives, adhesives suitable for the closure of tamper evident containers have a softening temperature which is below the melting point of the closure portion and of the sheet material. The softening temperature is commonly in the range of between 50° C. and 90° C. Accordingly, by the local application of heat, an unauthorized person can open and reseal the tamper evident container without any visible indication that the tamper evident container has been opened.

To discourage this practice, thermochromic inks have been used in tamper evident containers. These inks are formulated to develop a permanent, nonreversible, and visibly evident color change when the adhesive on the envelope is exposed to heating. In this way, if unauthorized access to e.g. a tamper evident container is attempted by means of local application of heat to an adhesive on the envelope, a color change in the ink makes this evident. Typical conventional thermochromic inks for this application are formulated from a leuco dye, a phenolic compound, an organic diluent, water, and polyvinyl alcohol. A thermochromic ink composition with improved wet abrasion resistance includes, in addition to the basic formulation of conventional inks, hydrolyzed poly(vinyl acetate) and an organic compound with at least one carbonyl group, preferably an aldehyde and more preferably a dialdehyde such as glyoxal. This improved ink composition is the subject of U.S. patent application Ser. No. 60/143211 assigned to a common assignee with the present application, and filed in the US Patent and Trademark Office on Jul. 9, 1999, and refiled as a regular application concurrently with the present application.

Although these thermochromic ink systems provide a good visual indication of unauthorized tampering with the tamper evident container or other article, they typically require the end user to know in advance about the change in color; otherwise, the color change triggered by subsequent tampering activity may go unnoticed.

Also, such ink systems can be circumvented by unauthorized personnel by removing the thermochromic ink coating with an organic or aqueous solvent. To prevent this, further protection must be provided by printing messages over the thermochromic ink layer or coating, to prevent or make obvious any tampering of the thermochromic ink layer itself prior to heating.

It is therefore desirable to provide an article, especially an article such as a tamper evident container which utilizes thermochromic ink, which offers improved evidence of tampering.

SUMMARY OF THE INVENTION

In a first aspect, a tamper evident container comprises a first portion; an opening capable of providing access to the interior of the tamper evident container; a closure portion arranged to be superposable with the first portion; an adhesive, applied to the first portion or closure portion, having a free surface so arranged as to seal the opening on superposition of the first portion and the closure portion; and an indicator which is capable of displaying a message; wherein the indicator is disposed, on superposition of the first portion and the closure portion, adjacent to the opening; and wherein the indicator comprises a first layer comprising a thermochromic ink composition, and a second layer, disposed on the first layer, comprising a composition different from the ink composition of the first layer.

In a second aspect, an article comprises a first layer comprising a first thermochromic ink composition; and a second layer, disposed on the first layer, comprising a composition different from the ink composition of the first layer.

In a third aspect, a tamper evident container comprises a first portion; an opening capable of providing access to the interior of the tamper evident container; a closure portion arranged to be superposable with the first portion; an adhesive, applied to the first portion or closure portion, having a free surface so arranged as to seal the opening on superposition of the first portion and the closure portion; and an indicator which is capable of displaying a message;

wherein the indicator is disposed, on superposition of the first portion and the closure portion, adjacent to the opening; and wherein the indicator comprises a substrate, and a message layer printed on the substrate, wherein the message is printed with a thermochromic ink.

In a fourth aspect, an article comprises a first substrate layer, a second layer, printed on the first substrate layer, wherein the second layer comprises a thermochromic ink; and a third, discontinuous layer, disposed on the second layer, wherein the third layer defines a message, and wherein the third layer comprises a deactivating agent, or non-thermochromic ink.

All compositional percentages used herein are presented on a "by weight" basis, unless designated otherwise.

Definitions

"Aqueous evident" herein refers to a continuous or discontinuous layer, coating, printing, or messaging that displays a visual change in color, shape, size, or pattern when contacted with an aqueous medium.

"Container" herein refers to bags, pouches, envelopes, or other articles which can store a product.

"Deactivating agent" herein refers to a chemical agent that prevents thermochromic ink, covered by the agent, from changing color upon heating to the normal activation temperature of the ink.

"Mechanical evident" herein refers to a continuous or discontinuous layer or layers, coating, printing, or messaging that displays a visual change in color, shape, size, or pattern when stretched, torn, or otherwise distorted, or when an attempt is made to open a container which includes the mechanical evident layer.

"Message" herein refers to any alphabetic, numeric, or alphanumeric message, warning, or statement; a design; a pattern; a logo; change in color, design, or pattern; or other indicia that communicates to the viewer that tampering has occurred or been attempted.

"Solvent evident" refers to a continuous or discontinuous layer, coating, printing, or messaging that displays a visual change in color, shape, size, or pattern when contacted with a solvent.

"Thermochromic" herein refers to an ink that exhibits a permanent, non-reversible, and visibly evident color change when exposed to heat.

BRIEF DESCRIPTION OF THE DRAWINGS

A detailed description of preferred embodiments of the invention follows, with reference to the attached drawings, wherein.

DETAILED DESCRIPTION OF THE INVENTION

Figure 1:
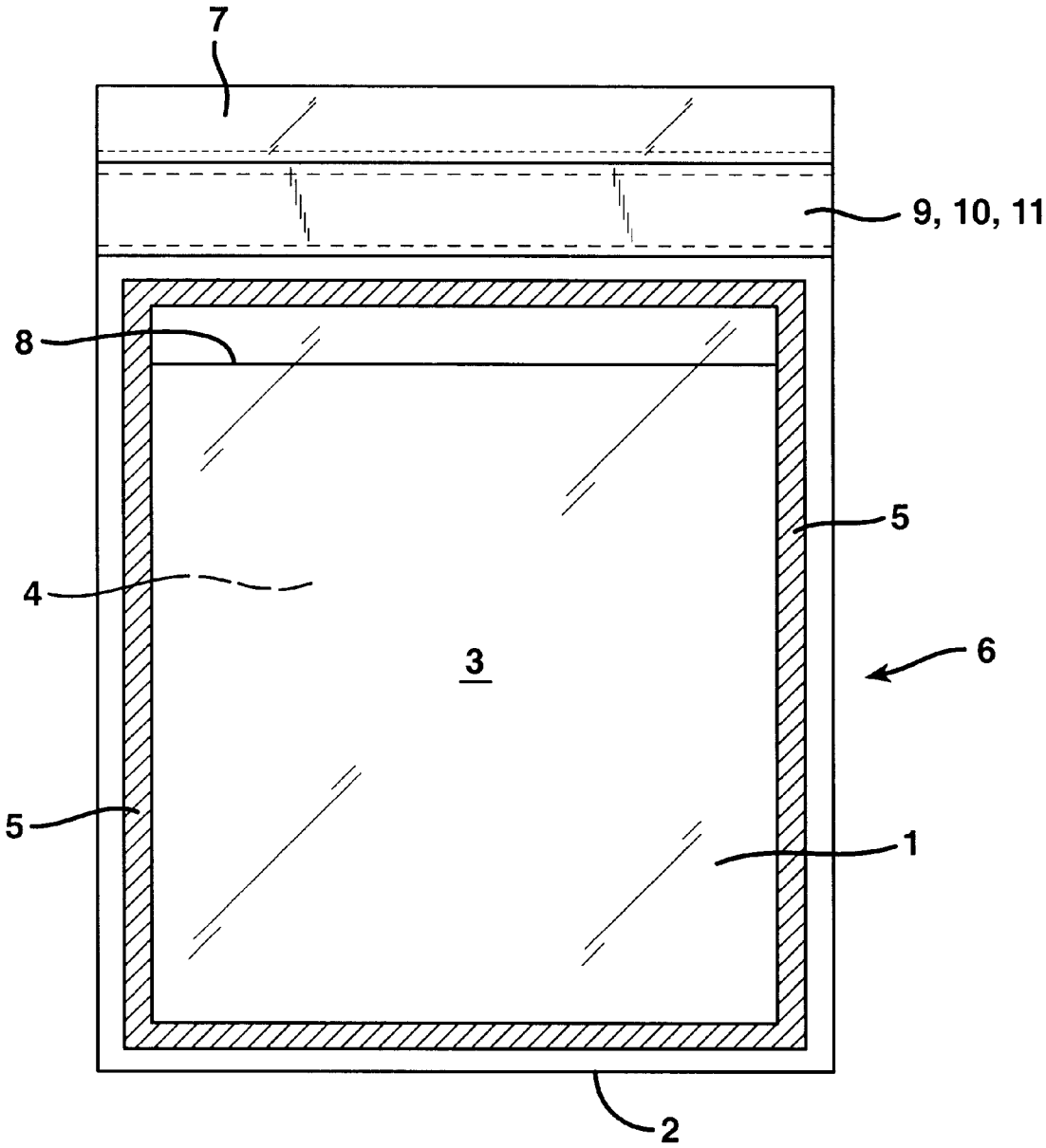
FIG. 1 is a diagrammatic front view of an open tamper evident container in accordance with a first embodiment of the present invention.

Referring to FIGS. 1 and 2, the tamper evident container is preferably formed from a single strip 1 of flexible thermoplastic sheet material. This sheet material can comprise any suitable material, preferably high density polyethylene, low density polyethylene, a blend of high density polyethylene and low density polyethylene, high density polyethylene with a filler, cellulose acetate, polyester, or polypropylene. For the sake of clarity, the sheet material is illustrated herein as a monolayer film. However, those skilled in the art will understand that multilayer films can also be beneficially used in connection with tamper evident containers. An example is a film with a polymeric core or inner layer, and two outside layers of high density polyethylene. The sheet material is folded laterally along a fold line 2 to form a first portion 3 and a second portion 4. The thermoplastic sheet material is preferably transparent, partially transparent or translucent, or a combination of opaque and transparent so as to make it easier to see evidence of tampering. The folded portions 3 and 4 are heat welded to each other in a zone 5 which extends parallel with and close to each of the longitudinal and each of the lateral edges of the portions to produce a tamper evident container 6 wherein the second portion 4 is longer than the first portion 3. The second portion 4 has a closure portion in the form of a flap 7. The flap portion 7 is preferably at least translucent, and more preferably is transparent.

At an end region of the tamper evident container 6 closer to the flap portion 7, an opening line in the form of a slit 8 extends across the first portion 3 terminating at each end at the weld zone 5. The slit 8 provides access to the interior of the tamper evident container 6. A band of adhesive 9 is provided on the flap portion 7. The choice of adhesive is not limited, although the adhesive should be a high tack adhesive having high cohesive and adhesive strength, such that any attempt to open the tamper evident container by separating the first portion and the closure portion will result in stretching, tearing, or other distortion of the first and/or closure portions, and can include any or all of those adhesives mentioned above. The adhesive 9 may be applied from the molten state or in the form of a tape, or by any other suitable method such as solvent cast or transfer tape technique. As can be seen from FIG. 2*a,* a releasable cover strip 10 is preferably provided to cover the free surface of the adhesive 9 when the tamper evident container is open.

Figure 2A:
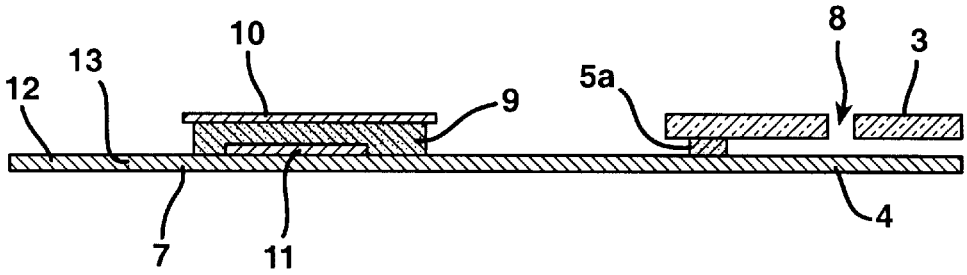
FIG. 2*a* is a diagrammatic section through a part of the tamper evident container of FIG. 1 on an increased scale when the tamper evident container is open.
Figure 2B:
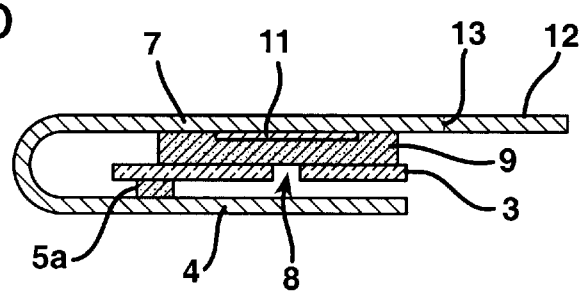
FIG. 2*b* is a diagrammatic section through a part of the tamper evident container of FIG. 1 when the tamper evident container is closed.
Figure 3A:
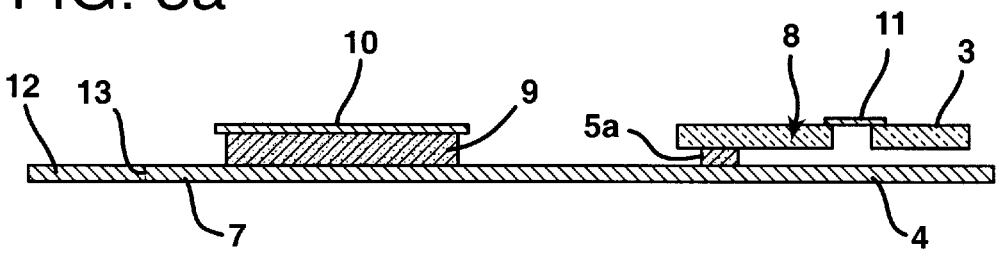
FIGS. 3*a* and 3*b* are respectively diagrammatic sections through a variation of the tamper evident container of the embodiment of FIG. 1 when open and closed.

As can be seen especially in FIGS. 2A and 3A, an indicator 11, comprising a first, thermochromic ink composition, and a second ink composition disposed over and different from the first, thermochromic ink composition, is provided on the flap portion 7 and is covered by the adhesive 9. The indicator is visible through the flap portion 7. The second ink composition can be a thermochromic ink composition different compositionally from the first thermochromic ink composition; a mechanical evident ink composition; or a combination of these.

When using the tamper evident container, the items to be held in the tamper evident container are introduced through the slit 8. The cover strip 10 is then removed from the adhesive 9 and the flap portion 7 is folded over onto the portion 3, with the fold line being close to the proximal laterally extending part of the weld zone 5. The disposition of the adhesive layer 9 relative to the fold line of the flap portion 7 is such that when the flap portion 7 is brought down onto the first portion 3, the part of the flap portion 7 carrying the adhesive 9 straddles the slit 8 so that the slit 8 is completely overlain by the said adhesive 9. Thus, the slit 8 is completely sealed and there is no access opening whatsoever to the interior of the tamper evident container 6 (see FIG. 2*b*). Preferably, the parts of the first portion 3 adjacent to the slit 8 have previously been subjected to a surface treatment such as corona discharge to assist adhesion of the adhesive to the substrate. The indicator 11 overlies at least that part of the portion 3 adjacent to the slit 8 which is distant from the lateral weld zone 5*a*. If desired, the flap portion 7 may include a receipt portion 12 which is detachable by means of perforations 13.

Figure 3B:
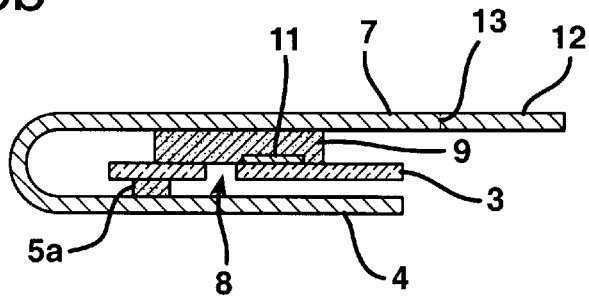

Referring to FIGS. 3*a* and 3*b,* in which parts corresponding to those of FIGS. 1 and 2 are indicated by like reference numerals, it will be seen that the indicator 11 can also be provided on at least that part of the portion 3 which is immediately adjacent the opening 8 distant from the lateral weld zone 5. After closure of the tamper evident container, the adhesive 9 completely overlies the opening slit 8 and the indicator 11. In this embodiment, the adhesive 9 must be translucent, or preferably transparent, to ensure that the indicator 11 is visible through the flap portion 7.

Figure 4:
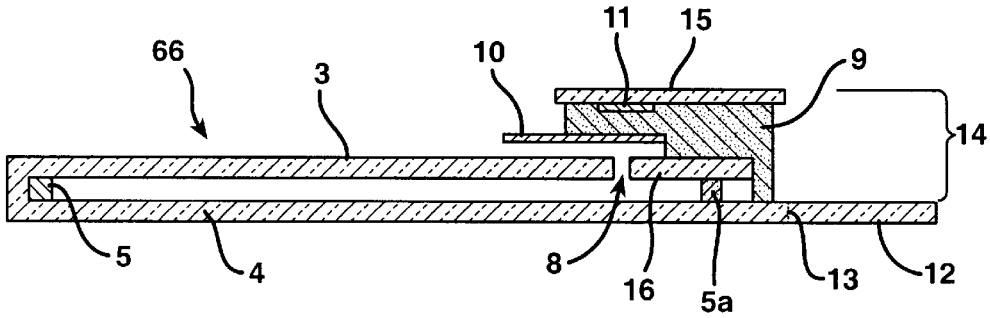
FIG. 4 is a diagrammatic section through a part of a tamper evident container of a second embodiment of the invention.

Referring to FIG. 4, in which parts corresponding to parts in FIGS. 1 to 3*b* have the same reference numerals, the tamper evident container 66, which is shown in the open state, can be sealed by a closure member 14. The closure member 14 comprises a thermoplastic substrate 15 which is at least translucent and preferably is transparent and which is adhered to at least a part of the section 16 of the first portion 3 along the whole lateral width of the tamper evident container, and optionally to the second portion 4, by an adhesive layer 9. A releasable cover strip 10 prevents adhesion of the closure member 15 to the first portion 3 adjacent to the opening 8 prior to the filling of the tamper evident container. In use, the items to be held in the tamper evident container are introduced through the slit 8, the cover strip 10 is removed, and the closure member 14 seals the opening 8 by completely overlying the same. The free surface of the adhesive 9 which is exposed on removal of the cover strip 10 adheres the substrate 15 to the first portion 3,16. An indicator 11 is provided on the transparent thermoplastic substrate 15 in such a position that, when the tamper evident container is sealed, the indicator overlies the opening 8, or at least that part of the first portion 3 which is adjacent to the opening 8 and distant from the lateral weld zone 5*a*. The indicator 11 may equally be applied to the adhesive 9 (by for example ink jet printing) or to the part of the first portion 3 adjacent the slit opening 8 and distant from the weld zone 5*a*.

Figure 5:
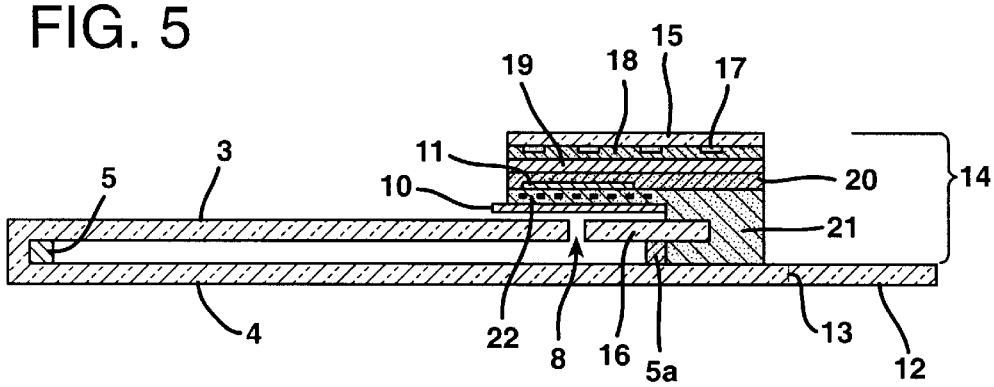
FIG. 5 is a diagrammatic section through a variation of the tamper evident container of FIG. 4 showing optional additional security features.

Further security features may be incorporated into the tamper evident containers as is particularly illustrated in FIG. 5, which is a variation of the embodiment of FIG. 4. These security features can also be incorporated into the embodiments of FIGS. 1 to 3. In FIG. 5, the closure member 14 comprises a transparent thermoplastic substrate 15 which carries a discontinuous weakly bonded adhesive layer 17 such as ethyl cellulose and a strongly bonded adhesive layer 18 such as epoxy cellulose acetate propionate. Because of the layers 17 and 18, any attempt to gain access to the interior of the tamper evident container 6 by lifting the substrate 15 will result in those parts of the layer 18 which are in registry with layer 17 remaining adhered to portions 3 and 4 whilst other parts of the layer 18 will remain adhered to substrate 15. This results in the formation of a visible pattern constituted by the split layer 18 which pattern cannot be obliterated by re-sealing the closure member. Soluble transparent or translucent dye may be carried in a layer 19. Layer 20 comprises a high tack adhesive in which the indicator 11 is disposed. It is not essential, however, for the indicator 11 to be disposed in the layer 20. Layer 21 is an optional second layer of adhesive which carries optional ink jet printing 22.

Figure 6:
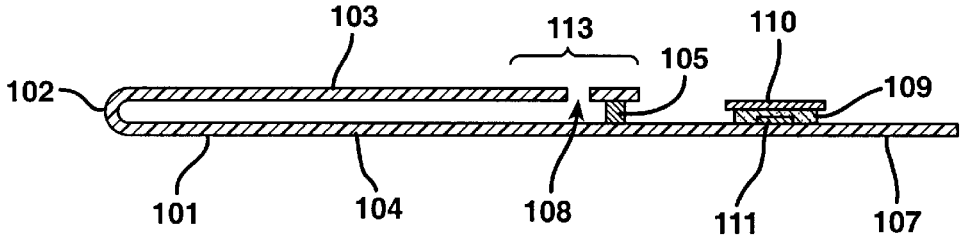
FIG. 6 is a diagrammatic section through a precursor of a tamper evident container of the first embodiment of the invention when the tamper evident container is open, during an exemplary production process.

Referring now to FIG. 6, the tamper evident container is produced by folding longitudinally a continuous length 101 of thermoplastic sheet material (after it has been optionally printed as appropriate) into a J-form where it includes a first portion 103 folded at fold 102 so as to be superposed on a part of a second portion 104 so as to leave a flap portion 107 of the second portion 104 exposed. The first portion 103 is heat sealed to the second portion 104 by a heat seal 105. Preferably, a region of the flap portion 107, which region is generally parallel to the heat seal 105, is subjected to a surface treatment such as corona discharge to improve its adhesion characteristics in that region. A band of high-tack adhesive 109 is applied to that region and is covered by a removable cover strip 110 optionally after having been provided with a security code by means of an ink jet printing technique. An indicator 111 can be applied to the flap portion 107 prior to the application of the adhesive 109. Alternatively, the indicator may be applied generally at region 1 13. The region indicated generally by 113 may also be subjected to a surface treatment such as corona discharge to improve its adhesion.

The continuous length 101 of sheet material is then cut transversely using a double heat sealing device comprising two pairs of heat sealing jaws between which is located a cutting blade so that the sheet material is cut into adjacent transverse sections each having heat sealed edges. Each of these sections constitutes a tamper evident container in accordance with the invention. It will be appreciated that a similar method can be applied for the production of the tamper evident containers in accordance with FIGS. 4 and 5. It is particularly advantageous to apply the closure member as a pre-made tape which will desirably incorporate the indicator.

Figure 7:
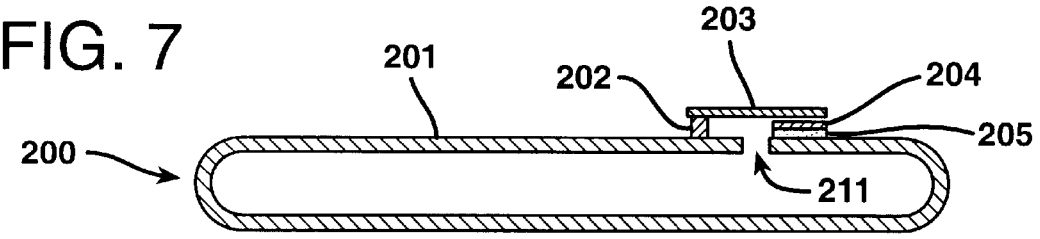
FIG. 7 is a diagrammatic section through a tamper evident container of a third embodiment of the invention.
Figure 11:
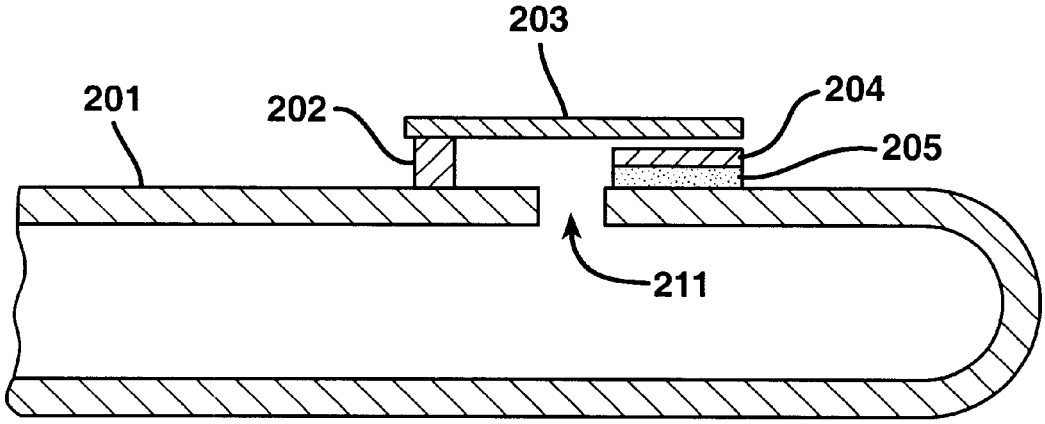
FIG. 11 is an enlarged view of a portion of FIG. 7.

Referring now to FIG. 7, a tamper evident envelope includes a sheet portion 201 to which a tamper evident tape 203, having printed or coated thereon, or including as a layer thereof, the thermochromic ink of the invention, is adhered by means of seal 202. Seal 202 can be e.g. a heat seal or an adhesive seal. Adhesive 205 is adhered to sheet portion 201, and is covered by a removable release liner 204. FIG. 11 is an enlargement of a portion of FIG. 7. In practice, after a product such as cash, a biological specimen, or some other object is placed through the opening 211 into the interior of container 200, the release liner 204 is removed to expose adhesive 205. The tamper evident tape 203 is then pressed against adhesive 205 to seal the container. If an unauthorized attempt is made to open the container by heating the adhesive 205 of the container to reduce the level of adhesion of adhesive 205 to tamper evident tape 203, the tape 203 will change color.

Figure 10:
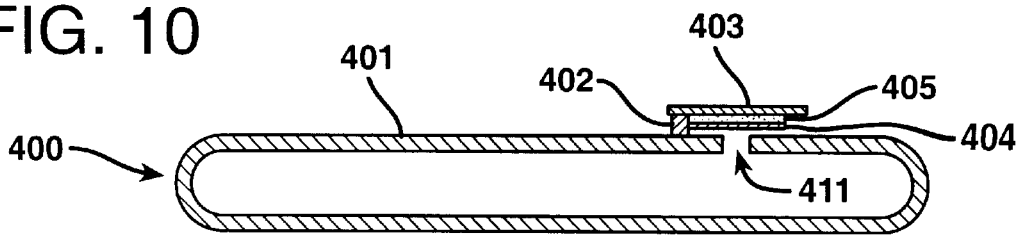
FIG. 10 is a diagrammatic section through a tamper evident container of a sixth embodiment of the invention.
Figure 12:
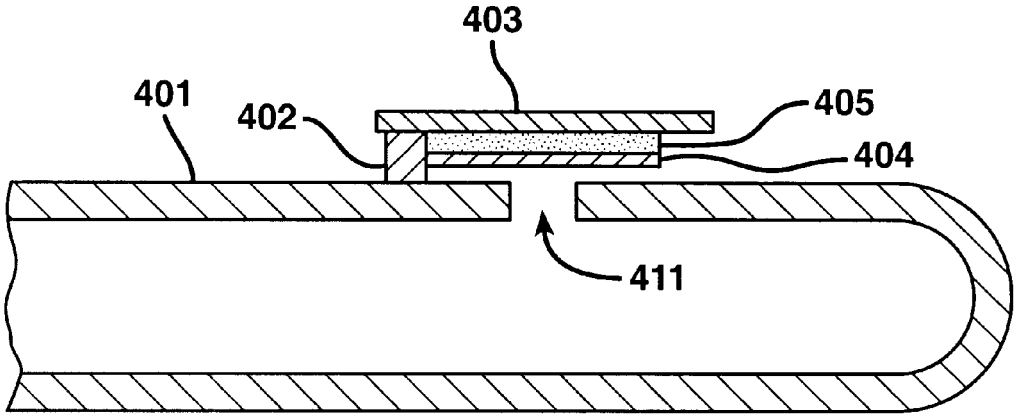
FIG. 12 is an enlarged view of a portion of FIG. 10.

FIG. 10 illustrates an alternative embodiment. A tamper evident container 400 includes a sheet portion 401 to which a tamper evident tape 403, having the indicator of the invention, is adhered by means of seal 402. Seal 402 can be e.g. a heat seal or an adhesive seal. Adhesive 405 is adhered to tamper evident tape 403, and is covered by a removable release liner 404. FIG. 12 is an enlargement of a portion of FIG. 10. In practice, after a product such as cash, a biological specimen, or some other object is placed through the opening 411 into the interior of container 400, the release liner 404 is removed to expose adhesive 405. The tamper evident tape 403, with adhesive 405 adhered thereto, is pressed against sheet portion 401 to seal the container. If an unauthorized attempt is made to open the container by heating the adhesive 405 of the container to reduce the level of adhesion of adhesive 405 to sheet portion 401, the tape 403 will change color.

Figure 8:
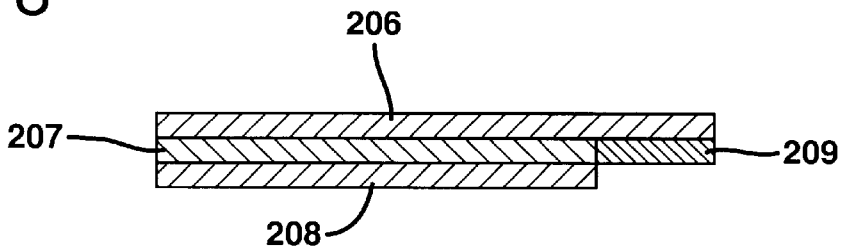
FIG. 8 is a diagrammatic section through a tape of a fourth embodiment of the invention.
Figure 9:
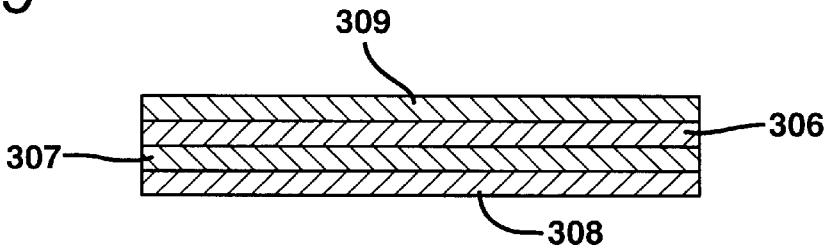
FIG. 9 is a diagrammatic section through a tape of a fifth embodiment of the invention.

FIGS. 8 and 9 illustrate two embodiments for either of tamper evident tape 203 or 403.

In FIG. 8, a tape film 206 can be made of a clear or colored polymeric material such as a polyolefin. Adhered to a portion of tape film 206 is a layer of a mechanical evident message print 207. This layer has a message printed thereon, generally masked by the tape film 206 and/or layer 208, which becomes visible and readable in the event someone seeks to gain access to the contents of the container by attempting to separate tape 203 or 403 from sheet material 201 or 401 respectively. Adhered to another portion of tape film 206 is a layer 209 of thermochromic ink. Adhered to layer 207 is a layer 208 of an overcoat print. This layer, generally of a single opaque color, masks the message of the message print layer 207 unless and until the container is opened.

In FIG. 9, a tape film 306 is made of a clear or colored polymeric material such as a polyolefin. Adhered to one side of tape film 306 is a layer 309 of thermochromic ink. Adhered to the other side of tape film 306 is a layer of a mechanical evident message print 307. This layer has a message printed thereon, generally masked by the tape film 306 and/or layer 308, which becomes visible and readable in the event someone seeks to gain access to the contents of the container by separating adhesive 205 or 405 from sheet material 201 or 401 respectively. Adhered to layer 307 is a layer 308 of an overcoat print. This layer, generally of a single opaque color, masks the message of the message print layer 307 unless and until the container is opened.

Figure 13:
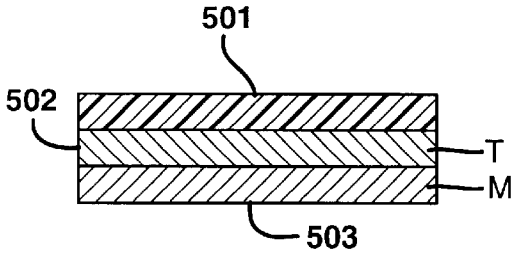
FIG. 13 is a diagrammatic section through a tape of a seventh embodiment of the invention.

In FIG. 13, a tape film 501 is made of a clear or colored polymeric material such as a polyolefin. Adhered to one side of tape film 501 is a layer 502 of thermochromic ink (indicated as "T" in the drawing). Adhered to layer 502 is a layer of a mechanical evident ink or message print 503 (indicated as "M" in the drawing).

Figure 14:
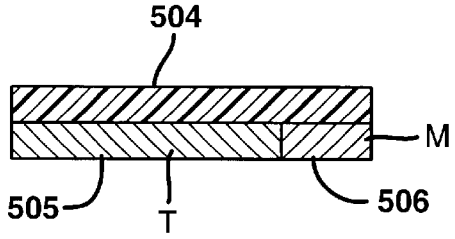
FIG. 14 is a diagrammatic section through a tape of an eighth embodiment of the invention.

In FIG. 14, a tape film 504 is made of a clear or colored polymeric material such as a polyolefin. Adhered to a portion of one side of tape film 504 is a layer 505 of thermochromic ink (indicated as "T" in the drawing). Adhered to another portion of one side of tape 504, and adjacent to layer 505, is a layer 506 of a mechanical evident ink or message print (indicated as "M" in the drawing).

Figure 15:
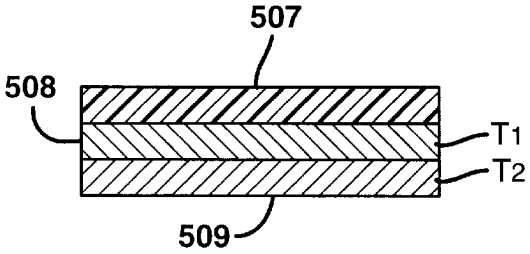
FIG. 15 is a diagrammatic section through a tape of a ninth embodiment of the invention.

In FIG. 15, a tape film 507 is made of a clear or colored polymeric material such as a polyolefin. Adhered to one side of tape film 507 is a layer 508 of a first thermochromic ink (indicated as "$T_1$" in the drawing). Adhered to layer 508 is a layer 509 of a second thermochromic ink or message print (indicated as "$T_2$" in the drawing).

Figure 16:
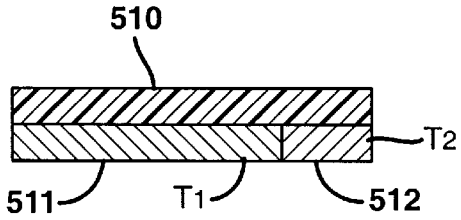
FIG. 16 is a diagrammatic section through a tape of a tenth embodiment of the invention.

In FIG. 16, a tape film 510 is made of a clear or colored polymeric material such as a polyolefin. Adhered to a portion of one side of tape film 510 is a layer 511 of a first thermochromic ink (indicated as "$T_1$" in the drawing). Adhered to another portion of one side of tape 510, and adjacent to layer 511, is a layer 512 of a second thermochromic ink or message print (indicated as "$T_2$" in the drawing).

Figure 17:
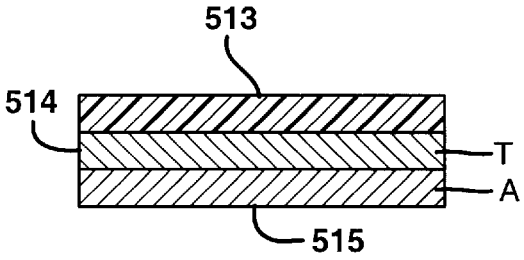
FIG. 17 is a diagrammatic section through a tape of an eleventh embodiment of the invention.

In FIG. 17, a tape film 513 is made of a clear or colored polymeric material such as a polyolefin. Adhered to one side of tape film 513 is a layer 514 of thermochromic ink (indicated as "T" in the drawing). Adhered to layer 514 is a layer of an aqueous evident ink or message print 515 (indicated as "A" in the drawing).

Figure 18:
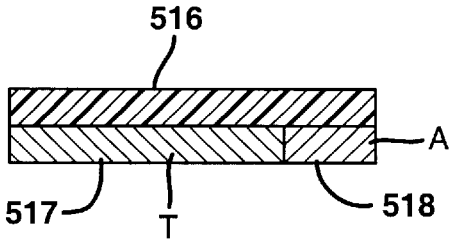
FIG. 18 is a diagrammatic section through a tape of a twelfth embodiment of the invention.

In FIG. 18, a tape film 516 is made of a clear or colored polymeric material such as a polyolefin. Adhered to a portion of one side of tape film 516 is a layer 517 of thermochromic ink (indicated as "T" in the drawing). Adhered to another portion of one side of tape 516, and adjacent to layer 517, is a layer 518 of an aqueous evident ink or message print 515 (indicated as "A" in the drawing).

Figure 19:
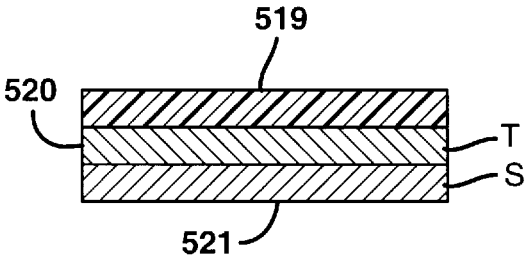
FIG. 19 is a diagrammatic section through a tape of a thirteenth embodiment of the invention.

In FIG. 19, a tape film 519 is made of a clear or colored polymeric material such as a polyolefin. Adhered to one side of tape film 519 is a layer 520 of thermochromic ink (indicated as "T" in the drawing). Adhered to layer 520 is a layer 521 of a solvent evident ink or message print (indicated as "S" in the drawing).

Figure 20:
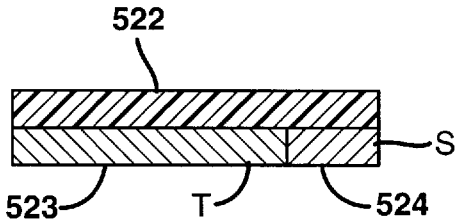
FIG. 20 is a diagrammatic section through a tape of a fourteenth embodiment of the invention.

In FIG. 20, a tape film 522 is made of a clear or colored polymeric material such as a polyolefin. Adhered to a portion of one side of tape film 522 is a layer 523 of thermochromic ink (indicated as "T" in the drawing). Adhered to another portion of one side of tape 522, and adjacent to layer 523, is a layer 524 of a solvent evident ink or message print (indicated as "S" in the drawing).

Figure 21:
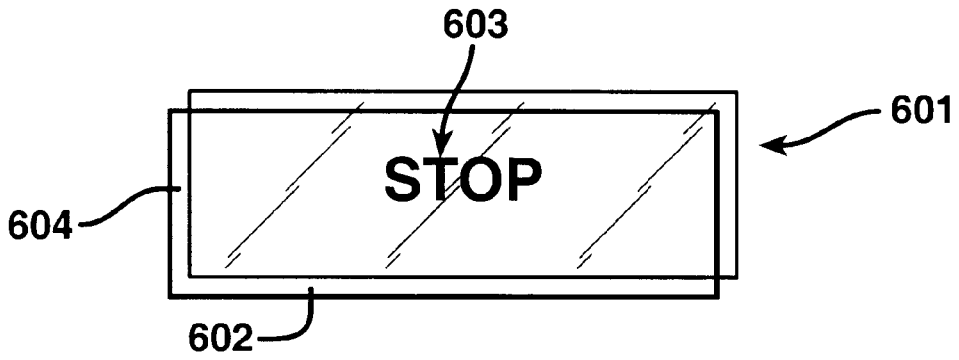
FIG. 21 is a plan schematic view of a printed, corona treated, and overcoated film of the invention.
Figure 22:
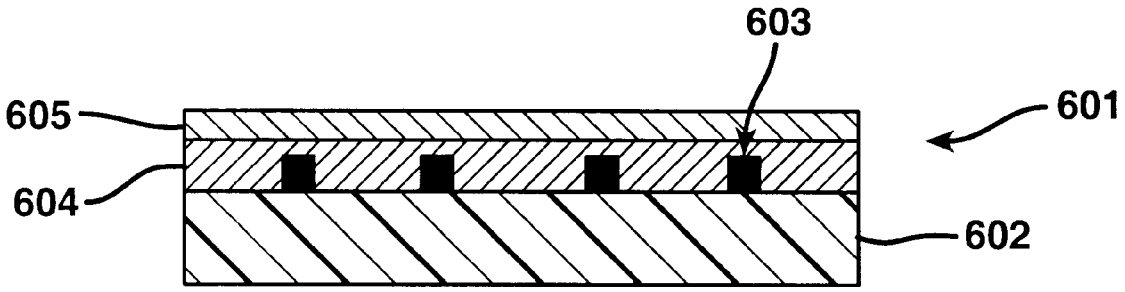
FIG. 22 is a side schematic view of the printed, corona treated, and overcoated film of FIG. 21.

Referring to FIGS. 21 and 22, the tamper evident tape 601 is constructed by printing a polymeric film 602, such as a polyethylene or other polyolefinic film, with a clear message 603. The film is transparent, translucent, colored or white. After printing the message, the printed film is corona treated on the printed side of tape 601. The printed, corona treated film is then flood coated by printing with an overcoat ink 604. The overcoat ink is a clear or colored ink, depending on the nature of the film. The purpose of the overcoat ink is to completely mask, i.e. make the message invisible when viewed through the film from the side opposite to that of printing. Additional colored inks 605 can be flood coated onto the printed, corona treated film by printing.

Figure 23:
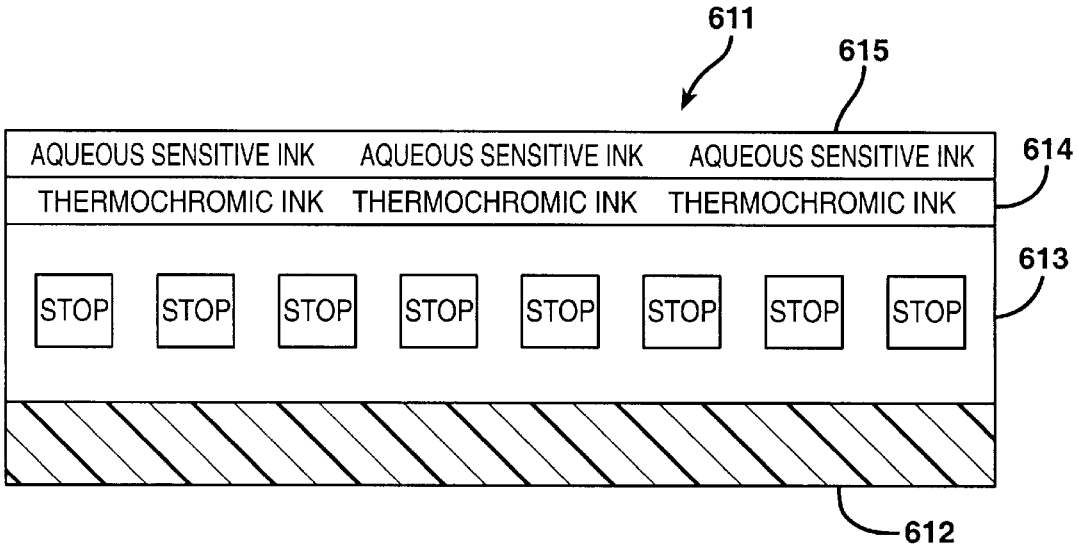
FIG. 23 is a side schematic view of a printed, corona treated film having a thermochromic ink layer, and an aqueous sensitive ink layer as a top layer.

Referring to FIG. 23, the tamper evident tape 611 is constructed by printing a polymeric film 612, such as a polyester, polyethylene or other polyolefinic film, with a clear message 613. The film is transparent, translucent, colored or white. After printing the message, the printed film is corona treated. The printed, corona treated film is then flood coated by printing with an overcoat thermochromic ink 614. The overcoat ink is a clear or colored ink, depending on the nature of the film. The purpose of the overcoat ink is to completely mask, i.e. make the message invisible when viewed through the film from the side opposite to that of printing. An aqueous sensitive ink 615 can be flood coated onto the printed, corona treated film by printing.

Figure 24:
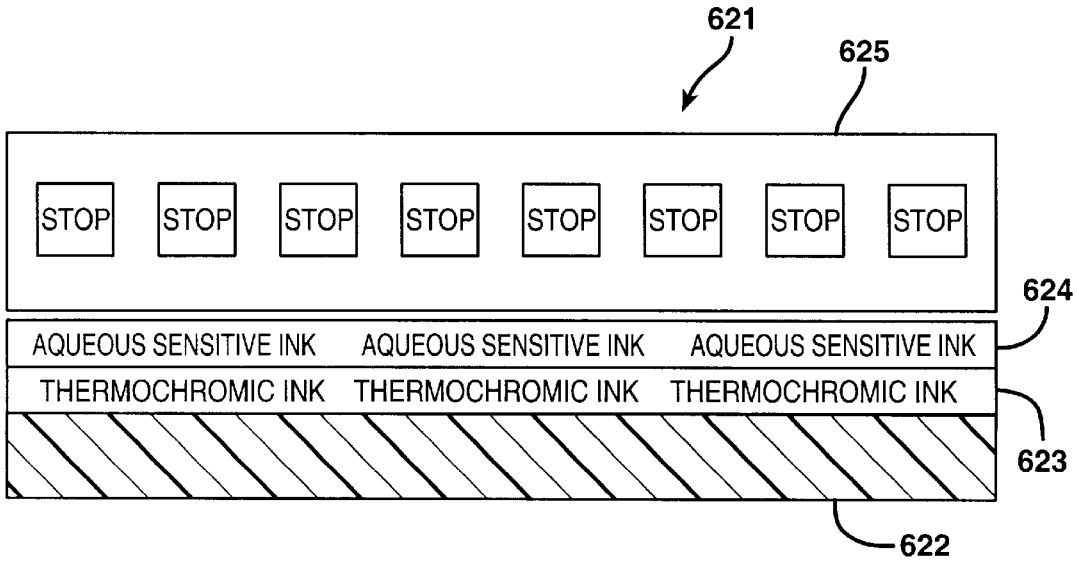
FIG. 24 is a side schematic view of a printed, corona treated film having an aqueous sensitive layer, and a thermochromic ink layer.

Referring to FIG. 24, the tamper evident tape 621 is constructed by printing a polymeric film 622, such as a polyethylene or other polyolefinic film, with a thermochromic ink layer 623. The film is transparent, translucent, colored or white. The thermochromic ink layer 623 is then coated by printing with an aqueous sensitive ink layer 624. Finally, a message 625 is printed on the aqueous sensitive ink layer 624.

The printed film when installed in or on the bag with adhesive, provides visible indication against mechanical tampering by preferentially separating at the printed areas. Referring again to FIG. 22, the printed message 603 easily separates from the film 602; in contrast, the flood coat layer 604 adheres well to the film 602 due to corona treatment. When the film is pulled away from the bag, the weak point in the system is the ink layers which fracture in areas where message was written. Even when the film is carefully set back into original position, the changes that occur in the two ink layers 603 and 604 after separation from the film causes unprinted film to show in between printed and overcoat areas in the form of an outline message. This outline message is an indication of tampering.

EXAMPLE 1

As an example, a message like "STOP" was printed on a translucent white film with clear ink and then corona treated. The same clear ink was printed as flood overcoat on top of the message. An orange ink was then printed as a flood coat. For testing, a clear adhesive tape (SCOTCH® tape) was placed over printed side of the printed film, i.e. was placed in contact with the orange flood coat. The adhesive tape was then partially pulled away to reveal the message. The adhesive tape was not completely removed from the film, and then was carefully placed back to match the two removed layers. Even after careful placement, the printed layers separated along the line of the message to reveal an outline of white message on an orange background.

EXAMPLE 2

In another example, a message like "STOP" was printed on a yellow translucent film with clear ink and then corona treated. A blue ink was then printed as flood overcoat on top of the message. The yellow film when viewed from the side opposite to the printed side appeared green. An adhesive tape was placed on the printed side and the tape was pulled to reveal the message. The tape was carefully placed back on the message. Even after careful placement, the printed layer separated along the line of message to reveal an outline of yellow message on a green background. In the examples illustrated in FIGS. 21 to 24, the symbol STOP is the printed message. The message area consists two or more ink layers including corona treatment. Thermochromic ink can be applied in a plurality of layers of similar or different inks. The aqueous sensitive ink can be e.g. saliva evident ink. The thermochromic ink can also be solvent evident. The message overcoat ink can also be either solvent or aqueous (saliva) evident.

Thermochromic ink can also be printed as message to give mechanical evidence.

Adhesive layers 205 and 405 can each form a single or multiple band, and can form a straight, wavy, continuous, or discontinuous line pattern or design.

Likewise, thermochromic ink layers 209 and 309 can each form a single or multiple band, and can form a straight, wavy, continuous, or discontinuous line pattern or design.

Thus, in accordance with the invention, a tape or other article is capable of showing evidence of heat, solvent, aqueous (including saliva), and mechanical tampering. Such a tape can be used in a wide variety of applications, and especially can be attached to a portion of a tamper evident container such as a tamper evident envelope. More specifically, the tape can be attached to or adjacent to part of the opening in a tamper evident envelope.

Depending on the choice of evidentiary ink compositions, multiple functions can be attained with the same indicator.

For example, heat evidence and solvent evidence can be attained with the same indicator.

Also, aqueous evidence and mechanical evidence can be attained with the same indicator.

Also, a thermochromic ink can be used to print a message on a substrate, and the thermochromic ink can be overprinted with one or more thermochromic or nonthermochromic inks. With the choice of colors of thermochromic and non-thermochromic inks, a message is completely hidden, if desired, in the multilayer printing. When heated, the thermochromic ink or inks are activated to show different colors. Thus, a heat evident signal (produced by the reaction of a thermochromic ink to heat) can be made to appear simultaneously in a different color from a background color to provide a high visual contrast when the indicator is heated above a certain temperature. This allows multiple colors and/or messages to be displayed, and makes for a more striking effect than from a single monochromatic message. An example appears below.

EXAMPLE 3

A thermoplastic tape was printed, using a first white thermochromic ink, with the letters "STOP" and then overprinted with another white thermochromic ink. The first ink was of a composition that, when heated, turns black. The second ink was of a composition that, when heated, turns pink. The initial appearance of the tape was a white band which did not reveal any lettering to an ordinary eye under normal viewing conditions. When the system was heated above the activation temperature of the inks, the letter "STOP" appeared in black on a pink background. The appearance of black letters with pink background, compared with the original appearance of a white band, provided excellent contrast and an unmistakable evidence of tampering.

Thus, even when the end user does not know in advance about the tamper evident feature of a container including the indicator of the invention, the subsequent dramatic change in color will make the tampering of the package quite evident, The printing with thermochromic ink on the tape is preferably on the same side as the mechanical evident messaging. Thus, once the article such as a tamper evident container has been sealed, the tape, having e.g. a polyethylene film substrate, protects the thermochromic ink from removal of the message by solvent or mechanical action. Prior to closing the container or other article, any tampering with solvent or aqueous medium, including saliva, is indicated by smearing or disappearance of an already printed message on the tape.

The invention is thus capable of providing an indicator that displays multiple colors with more than one message; solvent or aqueous evident printing adjacent to, or superimposed on, a thermochromic ink message; and multiple colors with more than one message appearing at different temperatures. In an alternative embodiment, thermochromic ink can be printed on a first portion of an envelope or other article, instead of on a discrete tape to be attached to the article, with single or multiple messages.

Although the invention has been described herein primarily with respect to tamper evident containers such as security envelopes, the invention can also be beneficially used in connection with the packaging or containment of biological materials or specimens, test samples, DNA evidence, forensic or criminal evidence, or any other product or item requiring some protection against tampering, theft, substitution, destruction, etc.

Also, although the article of the invention has been described herein primarily as a tamper evident container such as a security envelope, other articles can also be beneficially made utilizing the indicator of the invention. These articles include labels, tapes, foam trays, air cushioning films, shrink and non-shrink films, laminates, and temperature indicators.

Figure 25:
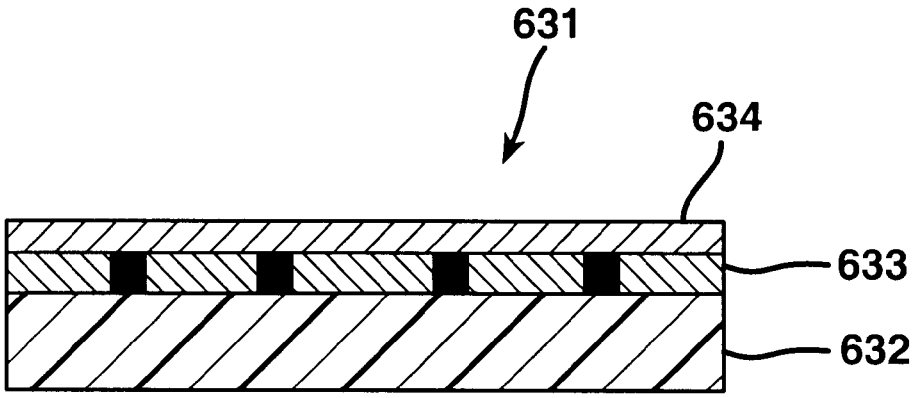
FIG. 25 is a side schematic view of a printed film according to an alternative embodiment of the invention.

An alternative embodiment, shown in FIG. 25, is a tape 631 in which a substrate film 632 has printed or other wise disposed thereon a message layer 633, wherein the message is for example in the form of stripes. An overcoat 634 of a thermochromic ink is disposed on message layer 633. As an example of this alternative embodiment, the message layer can be a color such as green, and the thermochromic ink of layer 634 will initially be of the same color as the message layer. The message is thus initially invisible. Upon subsequent exposure of the thermochromic ink of layer 634 to heat, the thermochromic ink turns clear, thus revealing the green colored message of layer 633.

In still another alternative, a first substrate layer, comprising materials such as those described above, can be coated with a second layer comprising a thermochromic ink. This second layer can in turn be coated with a third, discontinuous layer, of a deactivating agent, or a non-thermochromic ink having either the same color as the original color of the thermochromic ink, or a color that when disposed on the thermochromic ink is masked by the thermochromic ink. If a deactivating agent is used, this agent will prevent those portions of the thermochromic ink covered by the agent, from changing color upon heating. An example of deactivating agent is a flexographic printing ink containing a significant amount e.g. 5% of dibutyl phthallate. An alternative deactivating agent is MIRAGE™ PVB™ varnish, having reference number MXA 22481/2.

The deactivating agent or non-thermochromic ink is disposed on the thermochromic ink of the second layer in the form of a message. Thus, upon heating, the thermochromic ink of the second layer will change color except in areas covered by the deactivating agent or non-thermochromic ink. A message will become evident, with the message itself bearing the original color of the thermochromic ink, and the background of the message bearing the color of the thermochromic ink after activation.

Application of coatings can be done by any suitable and conventional process, such as spray coating, solvent coating, rotogravure, flexographic, and other processes.

Figure 26:
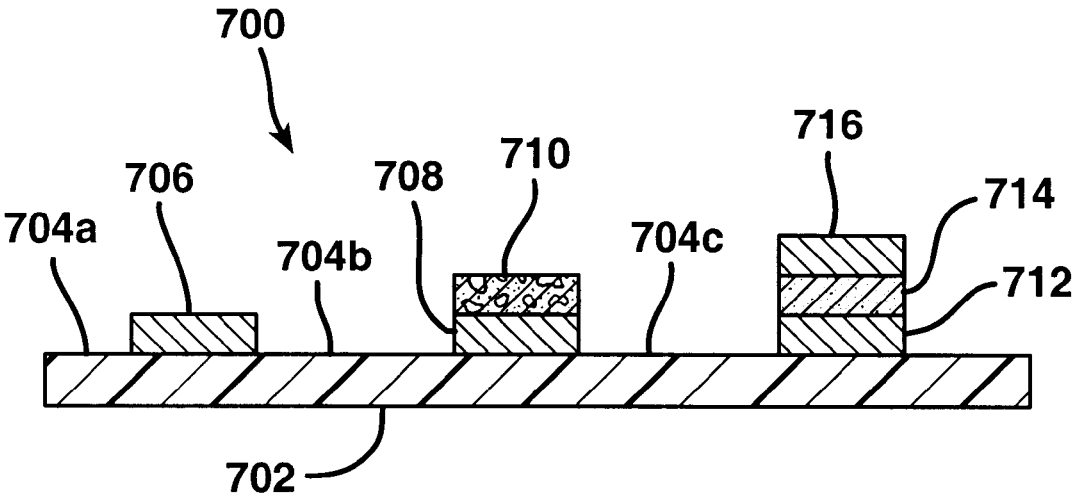
FIG. 26 is a side schematic view of a printed film according to an alternative embodiment of the invention.
Figure 27:
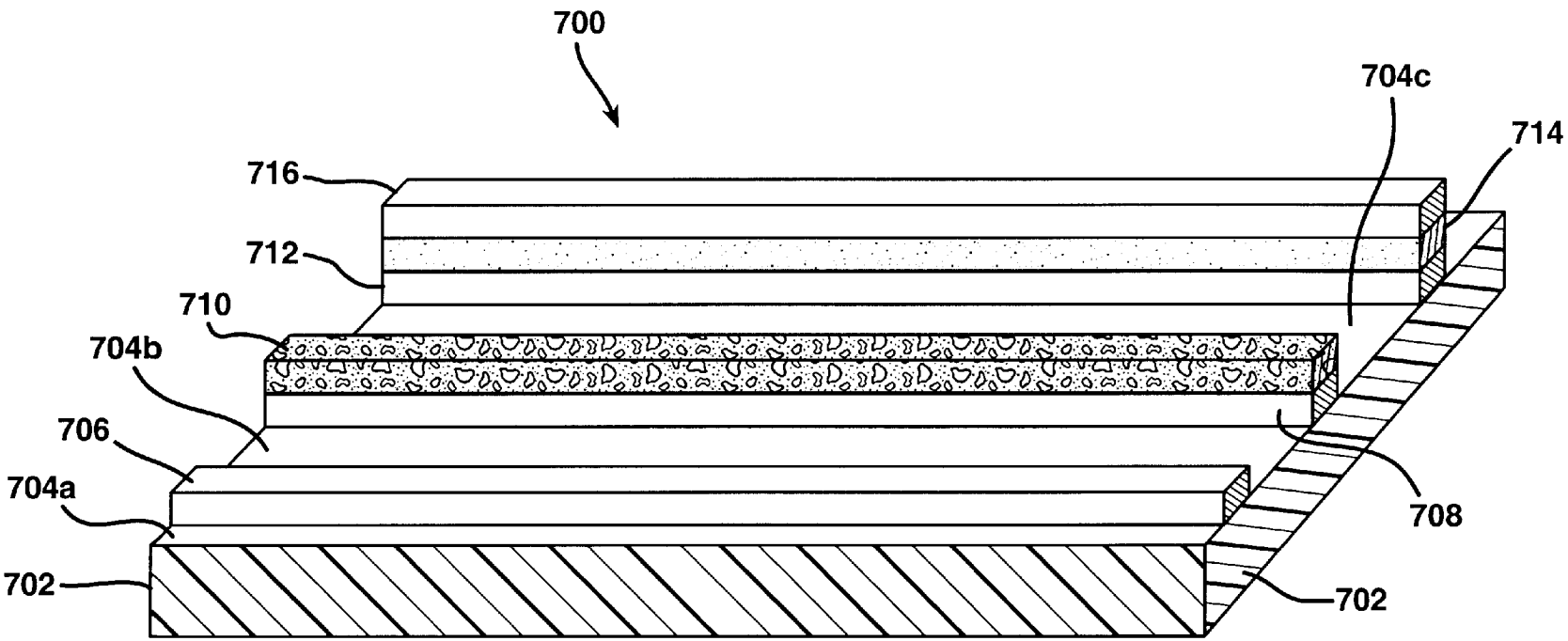
FIG. 27 is a perspective view of a printed film approximately according to the embodiment of FIG. 26.

Another alternative embodiment is shown in FIGS. 26 and 27. A tape, generally designated at 700, includes a substrate film 702. Multiple layers are arranged laterally and vertically along the upper surface of film 702. These layers can include layer 706 of aqueous evident ink; layer 708 of a thermochromic ink with a message (e.g. "STOP") printed thereon; layer 710 of a thermochromic or non-thermochromic ink flood coat or overcoat; layer 712 of a clear message print (e.g. "STOP"); layer 714 of a clear ink flood coat or overcoat; and layer 716 of a colored ink flood coat or overcoat. Although shown in a particular arrangement, those skilled in the art will understand that the various layer configurations can be rearranged horizontally or laterally; and that preferably a portion of the upper surface 704, designated as 704*a,* can be left without additional layers in order to form part of or accommodate a heat seal. Open portions 704*b* and 704*c* are optional, and any or all of the various layer configurations 706, 708/710, and 712/714/716 can be made contiguous with each other. (Markings in the layers of FIGS. 26 and 27 are intended only to visually distinguish the layers, not to indicate material type).

It is to be understood that variations of the present invention can be made without departing from the scope of the invention, which is not limited to the specific embodiments and examples disclosed herein, but extends to the claims presented below. For example, those skilled in the art will understand that although a specific tamper evident container is illustrated in FIG. 1, any suitable container can benefit from the invention. This includes containers where the opening for inserting securities, etc. is disposed essentially between front and rear panels of an envelope, at or near the top of the envelope.

Also, the tamper evident tape can be applied by heat sealing to either an exterior or interior surface of a sheet portion of the envelope, and can be applied by gluing to an exterior surface of a sheet portion of the envelope. Thus, e.g. by reference to FIG. 7, the tamper evident tape 203 can be adhered by heat seal 201 to the inside surface of sheet portion 201, instead of the outside surface as actually shown in the drawing. This can be especially useful in embodiments where the envelope comprises two sheet portions, one slightly longer than the other, the two sheet portions connected at a bottom fold or heat seal. An adhesive tape or adhesive region can be disposed laterally near the top or end of an interior surface of the longer sheet portion, and a tamper evident tape can be disposed near the top or end of an interior surface of the shorter sheet portion, the tamper evident tape adhered to the interior surface by heat sealing or other suitable adhering technique. After loading the envelope with a security, cash, etc. the adhesive can, after removal of any release tape, then be adhered to the tamper evident tape.

What is claimed is:

1. A tamper evident container comprising:

a) a first portion;

b) an opening capable of providing access to the interior of the tamper evident container;

c) a closure portion arranged to be superposable with the first portion;

d) an adhesive, applied to the first portion or closure portion, having a free surface so arranged as to seal the opening on superposition of the first portion and the closure portion; and e) an indicator which is capable of displaying a message, wherein the indicator is disposed, on superposition of the first portion and the closure portion, adjacent to the opening, and wherein the indicator comprises (i) a first layer comprising a thermochromic ink composition, and (ii) a second layer, disposed adjacent the first layer, comprising a composition different from the ink composition of the first layer.

2. The tamper evident container of claim 1 wherein the adhesive is disposed as a band on the first portion or closure portion.

3. The tamper evident container of claim 1 wherein the closure portion comprises a flap portion formed integrally with a portion of the sheet material of the tamper evident container.

4. The tamper evident container of claim 1 wherein the closure portion comprises a thermoplastic substrate to which the adhesive is applied, which substrate is affixed to the sheet material of the tamper evident container.

5. The tamper evident container of claim 1 wherein the opening is disposed in the first or closure portion of the container.

6. The tamper evident container of claim 1 wherein the opening is disposed between the first and closure portions of the container.

7. The tamper evident container of claim 1 wherein a releasable cover-strip is provided on the free surface of the adhesive.

8. The tamper evident container of claim 1 wherein the indicator is disposed on the closure portion.

9. The tamper evident container of claim 1 wherein the indicator is disposed on the first portion.

10. The tamper evident container of claim 1 wherein the second layer of the indicator comprises a composition selected from the group consisting of:

i) thermochromic ink;

ii) non-thermochromic ink;

iii) aqueous evident ink;

iv) mechanical evident ink;

v) solvent evident ink; and vi) deactivating agent.

11. The tamper evident container of claim 1 wherein the second layer of the indicator is disposed adjacent and in contiguous relationship to the first layer.

12. The tamper evident container of claim 1 wherein the second layer of the indicator is disposed adjacent and in spaced relationship to the first layer.

13. A tamper evident container comprises:

a) a first portion;

b) an opening capable of providing access to the interior of the tamper evident container;

c) a closure portion arranged to be superposable with the first portion;

d) an adhesive, applied to the first portion or closure portion, having a free surface so arranged as to seal the opening on superposition of the first portion and the closure portion; and e) an indicator which is capable of displaying a message, wherein the indicator is disposed, on superposition of the first portion and the closure portion, adjacent to the opening, and wherein the indicator comprises (i) a first printed layer comprising a first thermochromic ink composition, wherein the first thermochromic ink composition defines an alphabetic, numeric, or alphanumeric message; and (ii) a second layer, disposed on the first layer, comprising a second thermochromic ink composition different from the first thermochromic ink composition of the first layer.

14. The tamper evident container of claim 13 wherein the thermochromic ink composition of the first layer, when heated, changes to a first color, and the thermochromic ink composition of the second layer, when heated, changes to a color different from the first color.

15. The tamper evident container of claim 1 wherein the indicator comprises (i) a first layer comprising a thermochromic ink composition;

(ii) a second layer, disposed adjacent the first layer, comprising a composition selected from the group consisting of a) thermochromic ink;

b) non-thermochromic ink;

c) aqueous evident ink;

d) mechanical evident ink;

e) solvent evident ink; and f) deactivating agent; and (iii) a third layer, disposed adjacent the second layer, comprising a composition selected from the group consisting of a) thermochromic ink;

b) non-thermochromic ink;

c) aqueous evident ink;

d) mechanical evident ink;

e) solvent evident ink; and f) deactivating agent.

16. The tamper evident container of claim 15 wherein the second layer is disposed in adjacent and contiguous relationship to the first layer.

17. The tamper evident container of claim 15 wherein the second layer is disposed in adjacent and spaced relationship to the first layer.

18. The tamper evident container of claim 15 wherein the third layer is disposed in adjacent and contiguous relationship to the second layer.

19. The tamper evident container of claim 15 wherein the third layer is disposed in adjacent and spaced relationship to the second layer.

* * * * *